US007227301B2

(12) United States Patent
Sugimoto et al.

(10) Patent No.: US 7,227,301 B2
(45) Date of Patent: Jun. 5, 2007

(54) CATHODE-RAY TUBE DEVICE CAPABLE OF REDUCING MISCONVERGENCE

(75) Inventors: Kazuhiro Sugimoto, Ibaraki (JP); Katsuyo Iwasaki, Nishinomiya (JP)

(73) Assignee: Matsushita Electric Industrial Co., ltd., Osaka (JP)

( * ) Notice: Subject to any disclaimer, the term of this patent is extended or adjusted under 35 U.S.C. 154(b) by 536 days.

(21) Appl. No.: 10/918,310

(22) Filed: Aug. 13, 2004

(65) Prior Publication Data

US 2005/0067939 A1 Mar. 31, 2005

(30) Foreign Application Priority Data

Aug. 26, 2003 (JP) ..... 2003-301556

(51) Int. Cl.
*H01J 29/70* (2006.01)

(52) U.S. Cl. ..... 313/440; 313/441

(58) Field of Classification Search ..... 313/364–482; 335/210–214

See application file for complete search history.

(56) References Cited

U.S. PATENT DOCUMENTS 4,600,858 A * 7/1986 Iwasaki et al. ..... 313/413
4,728,915 A * 3/1988 Konosu et al. ..... 335/211
4,782,264 A * 11/1988 Yamazaki et al. ..... 313/413
4,876,479 A * 10/1989 Kawabata et al. ..... 313/440
6,046,538 A * 4/2000 Hishiki et al. ..... 313/440
2005/0023952 A1* 2/2005 Iwasaki et al. ..... 313/440

FOREIGN PATENT DOCUMENTS

JP 05-244614 9/1993

* cited by examiner

*Primary Examiner*—Nimesh Patel
*Assistant Examiner*—Christopher M. Raabe

(57) ABSTRACT

A cathode-ray tube device including a deflection yoke for deflecting an electron beam emitted from an electron gun in horizontal and vertical directions. The deflection yoke has a vertical deflection coil that deflects the electron beam vertically. The vertical deflection coil is wound toroidally around a bell-shaped ferrite core, and on the electron gun side of the ferrite core, a square "U" shaped magnetic body that is doubled back partway along in a longitudinal direction is disposed on the horizontal axis, so that the ends thereof extend towards and are separated along the tube axis.

14 Claims, 9 Drawing Sheets

CATHODE-RAY TUBE DEVICE CAPABLE OF REDUCING MISCONVERGENCE

This application is based on application no. 2003-301556 filed in Japan, the content of which is hereby incorporated by reference.

BACKGROUND OF THE INVENTION

1. Field of the Invention

The present invention relates to a cathode-ray tube used in television receivers, computer displays, and the like.

2. Related Art

Generally, color cathode-ray tube devices raster scan a phosphor screen formed on the inside of a face panel by deflecting three electron beams emitted from an in-line electron gun in horizontal and vertical directions using a deflection yoke having horizontal and vertical deflection coils.

Since the vertical deflection coil deflects the electron beams vertically, the distribution of a magnetic field generated by this coil (hereinafter, "vertical deflection magnetic field") has a so-called barrel shape, for example. On the other hand, since the horizontal deflection coil deflects the electron beams horizontally, the distribution of a magnetic field generated by this coil (hereinafter, "horizontal deflection magnetic field") has a so-called pincushion shape, for example. The deflection coils are made to generate magnetic fields having the above distributions in order to realize self-convergence in which the three electron beams are focused at a single point on the phosphor screen.

The vertical deflection coil is wound toroidally around a bell-shaped ferrite core attached to a resin frame (insulator). During the manufacturing process, the ferrite core sometimes gets attached with a central axis of the core offset laterally in relation to a central axis of the resin frame.

Here, "laterally" (left/right) is used to indicate the horizontal direction, with the boundary between left and right defined by a vertical plane that includes the tube axis of the cathode-ray tube when viewed from the screen side. On the other hand, "perpendicularly" (up/down) is used to indicate the vertical direction, with the boundary between up and down defined by a horizontal plane that includes the tube axis when viewed from the screen side.

When the deflection yoke is mounted in the cathode-ray tube so that the central axis of the resin frame is aligned with the tube axis of the cathode-ray tube, with the central axis of the ferrite core offset as described above, the distribution of the vertical deflection magnetic field ends up being asymmetrical on the left and right sides of the tube axis (a so-called "off-axis magnetic field") because of a central axis of the vertical deflection magnetic field being offset from the tube axis. As a result, misconvergence occurs in which the landing position of the three electron beams is vertically displaced (hereinafter, "Yv misconvergence").

Yv misconvergence is described here using a specific example. FIG. 1, in which a ferrite core 91 is seen from above, shows the distribution of the magnetic field generated by a vertical deflection coil when a central axis A of ferrite core 91 is offset to the right of a tube axis Z when viewed from the screen side. FIG. 2 shows Yv misconvergence that occurs on the screen when the distribution of the magnetic field generated by the vertical deflection coil is as shown in FIG. 1.

Note that a horizontal deflection coil wound around ferrite core 91 is not depicted in FIG. 1 because of a vertical deflection magnetic field 92 distributed within ferrite core 91 being displayed. The orientation of magnetic field 92 when the electron beams have been upwardly deflected is indicated in FIG. 1 by the arrows.

The electron beams, when viewed from the screen side, are emitted from an electron gun 94 arranged in-line in the order blue (B), green (G) and red (R) from the left-hand side (in FIG. 1, red, green, blue are indicated by "R", "G", "B", respectively). Also, the magnetic flux density of the distribution of magnetic field 92 increases as the distance from the central axis of magnetic field 92 increases, due to the barrel shape of this magnetic field.

Consequently, the blue electron beam B positioned on the far left of the three electron beams is effected the most by the off-axis magnetic field, followed by the green electron beam G. As a result, the landing position of the three electron beams is, as shown in FIG. 2, displaced perpendicularly, being blue, green, red from the top ("R", "G", "B" also being used in FIG. 2 to indicate red, green, blue). Note that Yv misconvergence causes color shifts and the like.

One method for correcting Yv misconvergence involves making use of a leakage magnetic field 93 (see FIG. 1) that leaks from the magnetic field generated by the vertical deflection coil to the outside of the deflection yoke on the electron gun side (e.g. see Japanese Patent Application Publication 5-244614). According to this method, the leakage magnetic field from the vertical deflection coil is either focused or dispersed to locally strengthen or weaken the leaked magnetic field, by attaching two substantially "L" shaped magnetic bodies to the left and right of the tube axis on the end face of the deflection yoke on the electron gun side, so that the arm of each magnetic body is parallel with the tube axis.

While misconvergence can be reduced with this method, the reduction is small and the applicable range is limited.

SUMMARY OF THE INVENTION

The present invention, which arose in view of the above problems, aims to provide a cathode-ray tube device capable of increasing reductions in misconvergence with a simple structure, by effectively using a magnetic field that occurs when deflecting an electron beam.

In order to achieve the above object, a cathode-ray tube device pertaining to the present invention is constituted from a cathode-ray tube that includes a glass bulb having a funnel connected to a face panel, and an electron gun disposed within a neck of the funnel; a deflection yoke that is mounted around an outside of the funnel and deflects an electron beam emitted from the electron gun; and a magnetic body doubled back partway along in a longitudinal direction so that a first end and a second end in the longitudinal direction extend toward a tube axis of the cathode-ray tube, and provided in a vicinity of an electron gun side of the deflection yoke, with the first end positioned nearer the deflection yoke than the second end.

Here, the magnetic body doubled back partway along in a longitudinal direction is a concept that includes magnetic bodies that are, for example, square "U" shaped, "M" shaped, asymmetrical "V" shaped, or semi-oval shaped.

According to this structure, the distribution of a magnetic field that occurs when deflecting an electron beam (e.g. a leakage magnetic field that leaks from the deflection yoke on the electron gun side) in a vicinity of one end of the magnetic body can be changed as a result of the leakage magnetic field being drawn into the one end, and a magnetic field can, furthermore, be applied in a direction that reduces misconvergence of the electron beam by releasing the absorbed leakage magnetic field toward the tube axis from the other end of the magnetic body.

Consequently, it is possible to greatly increase the reduction in misconvergence with a simple structure, by effectively using a magnetic field that occurs when deflecting an electron beam.

The magnetic body may have a squared "U" shape, and be disposed in a state in which, of opposing arms, at least the arm nearer the deflection yoke is substantially parallel with an end face of the deflection yoke on the electron gun side. Also, the magnetic body may be disposed in a state in which, of opposing arms, the arm nearer the electron gun is substantially orthogonal to the tube axis.

A vertical deflection coil included in the deflection yoke may generate a barrel-shaped magnetic field, and the magnetic body may be disposed with a central axis, which is parallel with a longitudinal direction of at least one of opposing arms of the magnetic body, substantially aligned with a horizontal axis of the cathode-ray tube.

Here, the "horizontal axis" is an axis in the horizontal direction that cuts the axis of the cathode-ray tube orthogonally.

Furthermore, the magnetic body may be provided only on a side of the tube axis opposite that on which a vertical deflection coil included in the deflection yoke is laterally offset, so that the tube axis is positioned therebetween. Also, the vertical deflection coil may be toroidally wound around a bell-shaped core, and the magnetic body may be mounted on an end face of a minor diameter side of the core.

BRIEF DESCRIPTION OF THE DRAWINGS

These and other objects, advantages, and features of the invention will become apparent from the following description thereof taken in conjunction with the accompanying drawings, which illustrate a specific embodiment of the present invention.

In the drawings.

DETAILED DESCRIPTION OF PREFERRED EMBODIMENT

A cathode-ray tube device, which is an embodiment of the present invention, is described below with reference to the drawings.

1. Overall Structure of Cathode-Ray Tube Device

Figure 3:
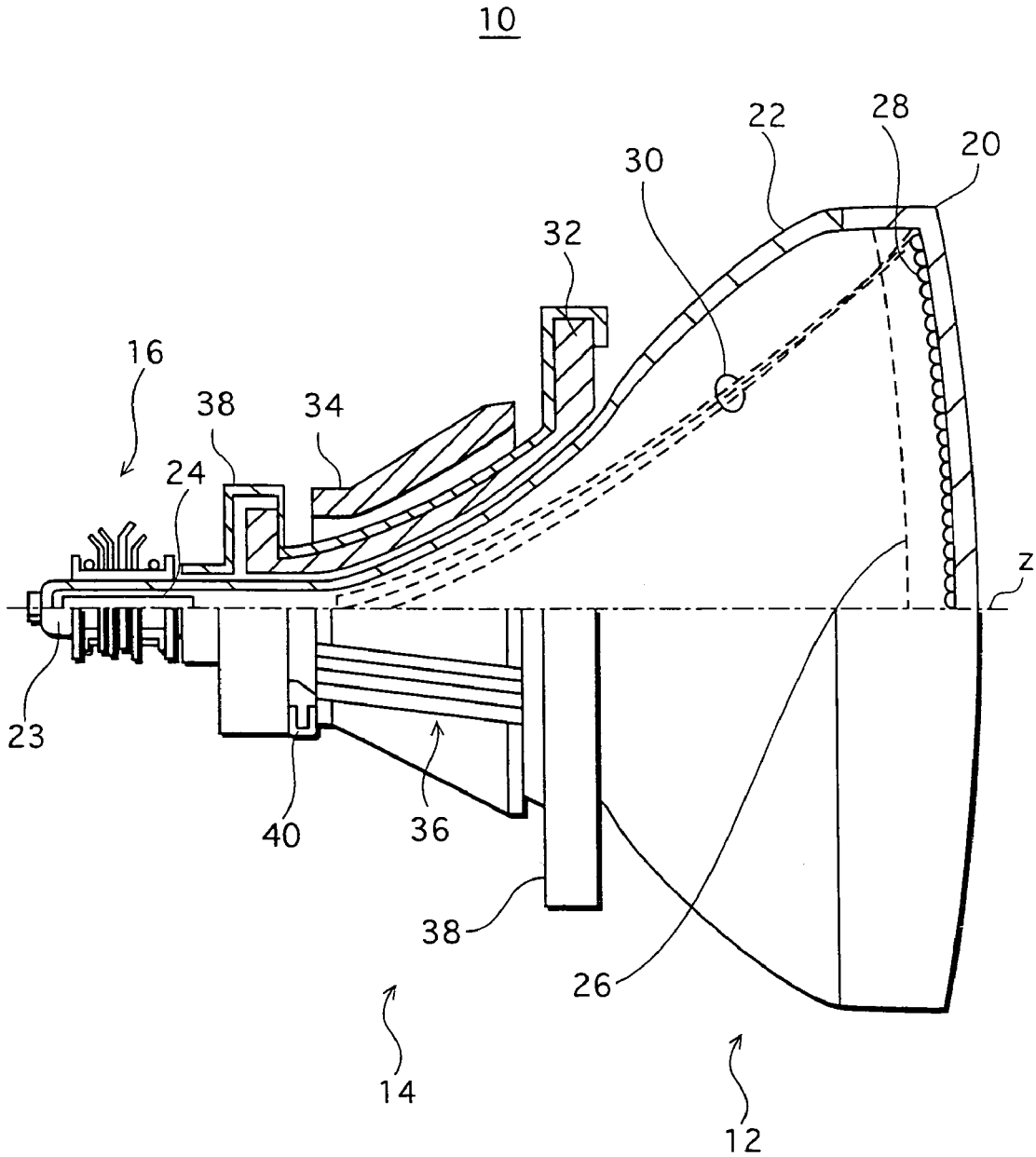
FIG. 3 is a half horizontal sectional view showing a schematic structure of a color cathode-ray tube device pertaining to the present invention.

FIG. 3 is a half horizontal sectional view showing a schematic structure of a color cathode-ray tube device 10 pertaining to the present invention. Device 10 is formed from a color cathode-ray tube 12, a deflection yoke 14, a convergence and purity unit (CPU) 16, and the like.

Color cathode-ray tube 12 houses an in-line electron gun 24, a shadow mask 26 and the like within a glass bulb formed from a funnel 22 connected to a face panel 20.

A phosphor screen 28 constituted from systematically arranged red, green and blue phosphors is formed on the inner surface of face panel 20. Numerous thru holes are formed in shadow mask 26 for electron beams 30 to pass through, thereby allowing the three electron beams 30 emitted from electron gun 24 to correctly strike respective phosphors.

Deflection yoke 14, which is attached around the outside of funnel 22 toward the neck end of the funnel, deflects the three electron beams 30 emitted from electron gun 24 vertically (up/down) and horizontally (left/right) to scan the electron beams over phosphor screen 28 using a raster scan method.

Deflection yoke 14 includes a vertical deflection coil 36 for deflecting electron beams 30 vertically, and a horizontal deflection coil 32 for deflecting electron beams 30 horizontally. The magnetic fields generated respectively by deflection coils 32 and 36 are, as described in the Related Art section, barrel shaped and pincushion shaped in order to realize self-convergence.

A resin frame 38 is provided between deflection coils 32 and 36. Resin frame 38 holds deflection coils 32 and 36 in position, as well as maintaining the electrically insulated state of the deflection coils.

Horizontal deflection coil 32 is formed from coil wire wound in a saddle shape, for example, on the inside of resin frame 38, while vertical deflection coil 36, which is on the outside of resin frame 38, is formed from coil wire wound in a toroidal shape, for example, around a ferrite core 34.

A magnetic body 40 having a squared "U" shape is attached on the electron gun side of ferrite core 34 for correcting/reducing Yv misconvergence. Vertical deflection coil 36, ferrite core 34, and magnetic body 40 are described in detail in a later section.

Electron gun 24 is housed within neck 23. In electron gun 24, three cathodes (not depicted), which are heated separately by three heaters (not depicted), are arranged in-line in a horizontal direction.

Finally, CPU 16, which is a well-known component formed from a plurality (e.g. four) magnet rings, is provided in a position corresponding to electron gun 24, the adjustment of static convergence, purity and the like relating to electron beams 30 being carried out by CPU 16. Note that deflection yoke 14 is provisionally fixed in color cathode-ray tube 12 while these adjustments are being carried out, and then secured once the adjustments have been completed.

2. Vertical Deflection Coil and Magnetic Body

Figure 4:
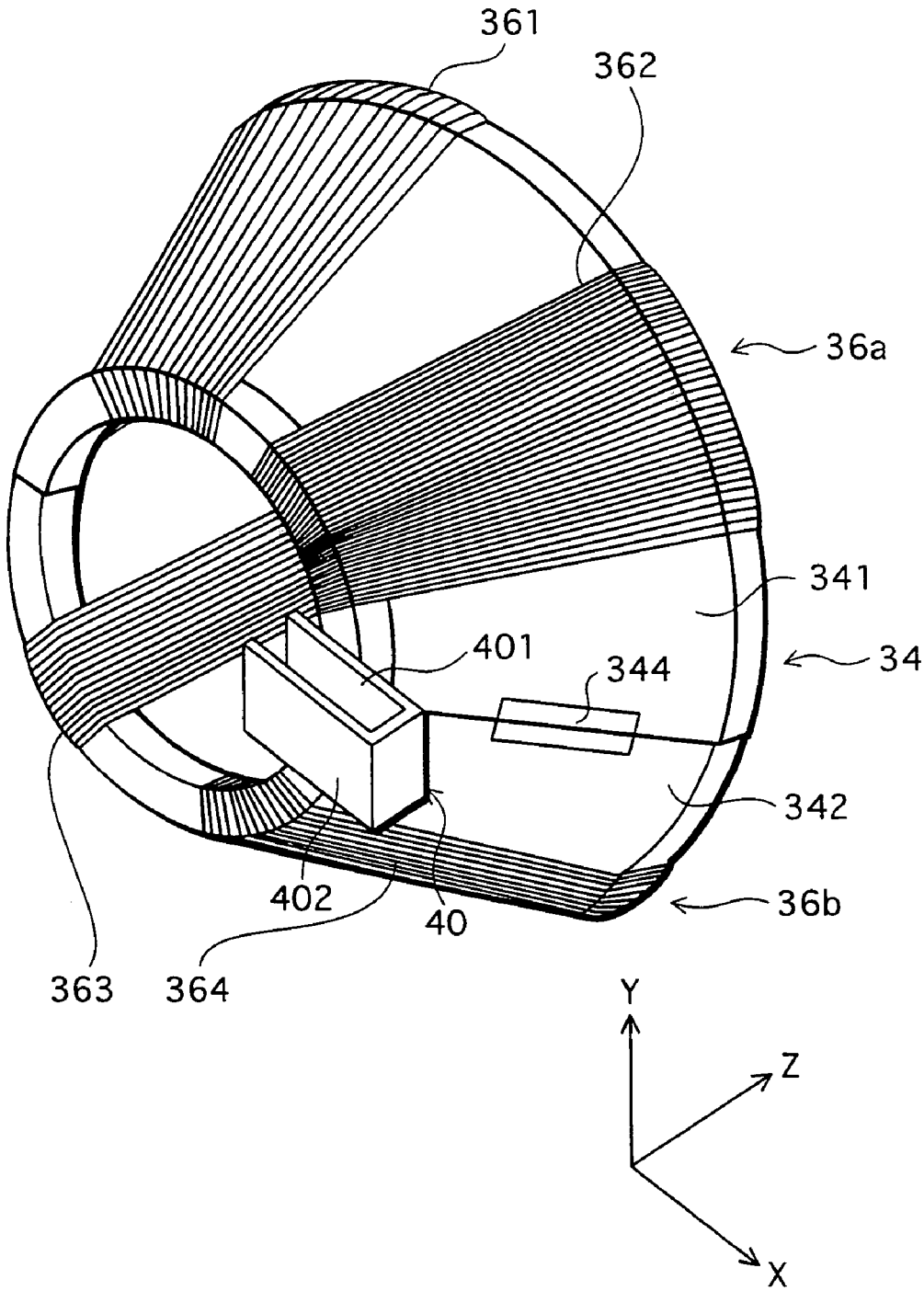
FIG. 4 is an external perspective view of a ferrite core around which the vertical deflection coil has been toroidally wound.

FIG. 4 is an external perspective view of ferrite core 34 and vertical deflection coil 36 wound toroidally around the ferrite core.

Ferrite core 34 is, as shown in FIG. 4, a substantially bell-shaped component formed from two parts, with an upper core 341 and a lower core 342 secured together by a hold-down 344. Vertical deflection coil 36 is formed from an upper coil 36*a* and a lower coil 36*b*, with the upper and lower coils facing one another vertically. In upper coil 36*a* a first coil bundle 361 and a second coil bundle 362 are connected in series, and in lower coil 36*b* a third coil bundle 363 and a fourth coil bundle 364 are connected in series. Note that while the ferrite core is formed here from upper and lower parts (i.e. two parts), the ferrite core may, for example, be formed from left and right parts, and nor is the number of parts limited to two.

Magnetic body 40 is described next.

Magnetic body 40 is, as shown in FIGS. 3 and 4, disposed in a vicinity of the end of ferrite core 34 on the electron gun side.

Figure 5:
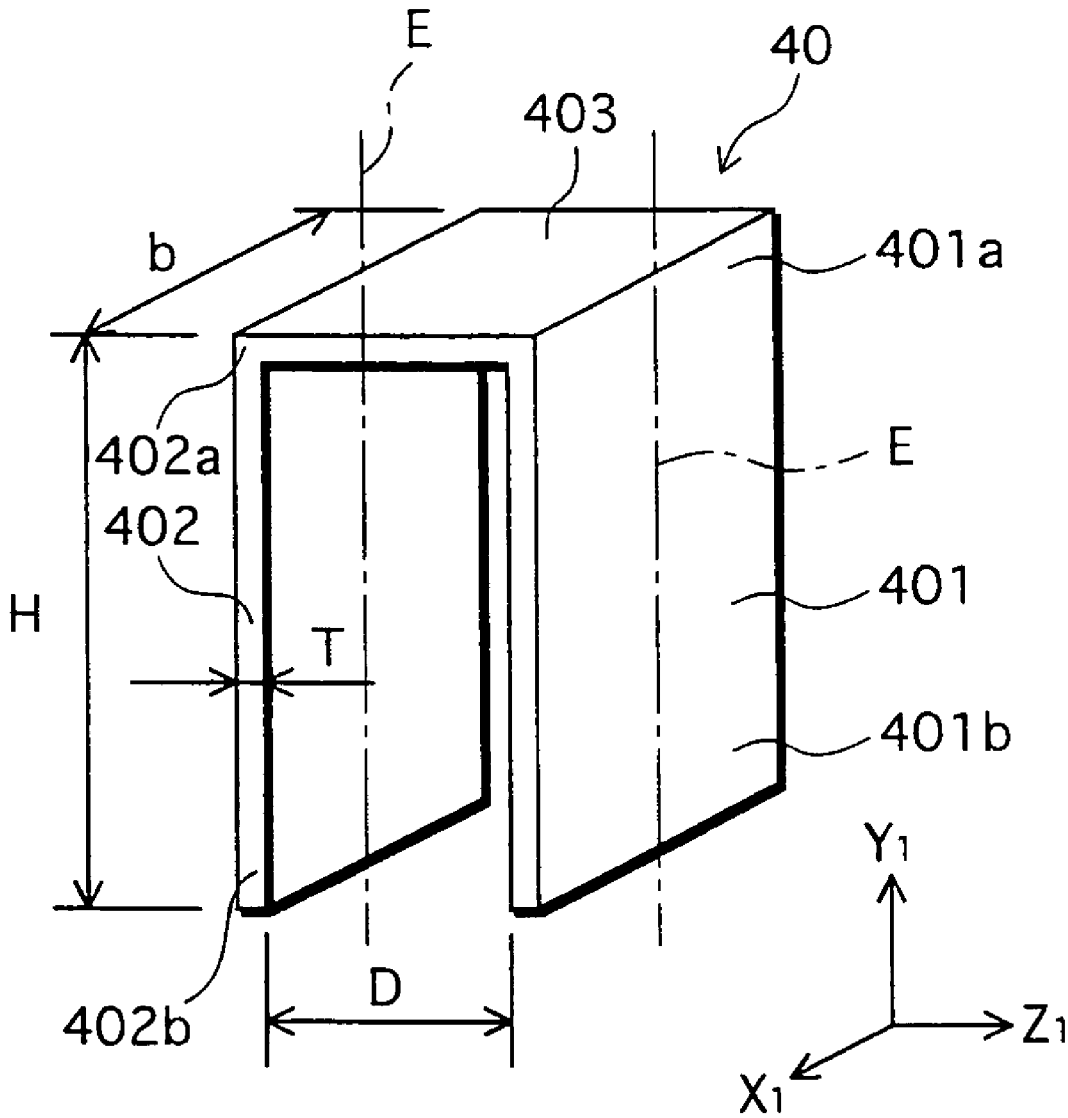
FIG. 5 is an external perspective view of a magnetic body.

FIG. 5 is a perspective view of magnetic body 40.

Magnetic body 40 is, as shown in FIG. 5, constituted by doubling back an elongated member partway along in the longitudinal direction, so that a first end and a second end thereof in the longitudinal direction extend toward the tube axis of the cathode-ray tube. Magnetic body 40 is formed as one piece, with a substantially parallel pair of opposing arms 401 and 402, which are disposed facing one another, being connected at respective ends 401*a* and 402*a* by a connecting part 403 (ends 401*a* and 402*a* equate to the bent parts mentioned above). Magnetic body 40 has a squared "U" shape, for example.

Here, the height of magnetic body 40 is in the longitudinal direction of opposing arms 401 and 402 ($Y_1$ direction in FIG. 5), the width is in the breadthwise direction of opposing arms 401 and 402 ($X_1$ direction in FIG. 5), and the thickness is in the direction in which opposing arms 401 and 402 are connected ($Z_1$ direction in FIG. 5).

Magnetic body 40 is, for example, constituted using silicon steel, and formed, for example, by pressing a sheet cut to predetermined measurements.

Magnetic body 40 is, as shown in FIGS. 3 and 4, attached to ferrite core 34 by affixing opposing arm 401 to an end face of ferrite core 34 on the electron gun side, with ends 401*b* and 402*b* of opposing arms 401 and 402 (i.e. opposite ends to connecting part 403) extending toward tube axis Z, and a center line E (displayed by the broken chain lines in FIG. 5 and corresponding to a central axis parallel with the longitudinal direction of the opposing arms in the present invention) that is approximately orthogonal to tube axis Z and passes through the approximate center of magnetic body 40 in the width direction is substantially aligned with the horizontal axis of cathode-ray tube 12 (i.e. state in which end part 401*b* (equating to the first end in the present invention) of end parts 401*b* and 402*b* is positioned nearer ferrite core 34 (deflection yoke 14) than the other end part 402*b* (equating to the second end)). Note that with this configuration, magnetic body 40 is affixed using an adhesive, for example. The adhesive may be a synthetic resin material such as silicon, and preferably is non-corrosive.

3. Amelioration of Misconvergence by Attaching Magnetic Body a. Test Results

The amelioration of Yv misconvergence resulting from the attachment of magnetic body 40 to deflection yoke 14 (ferrite core 34) is described here.

Firstly, the amount of Yv misconvergence was measured using a color cathode-ray tube device with an off-axis magnetic field.

The color cathode-ray tube device used was a 29-inch flat screen type with a deflection angle of 104 degrees. Ferrite core 34 was approximately 43 mm long in the axial direction (same as tube axis of cathode-ray tube), and had an external diameter of 55 mm and 110 mm on the electron gun and face panel sides, respectively.

As described in the Related Art section of this specification, ferrite core 34 was attached to resin frame 38 with the central axis thereof offset to the right side, for example, of the central axis of resin frame 38 when viewed from the screen side. This state is described here using FIGS. 1 and 2 since the content is the same as that described in the Related Art section.

Figure 1:
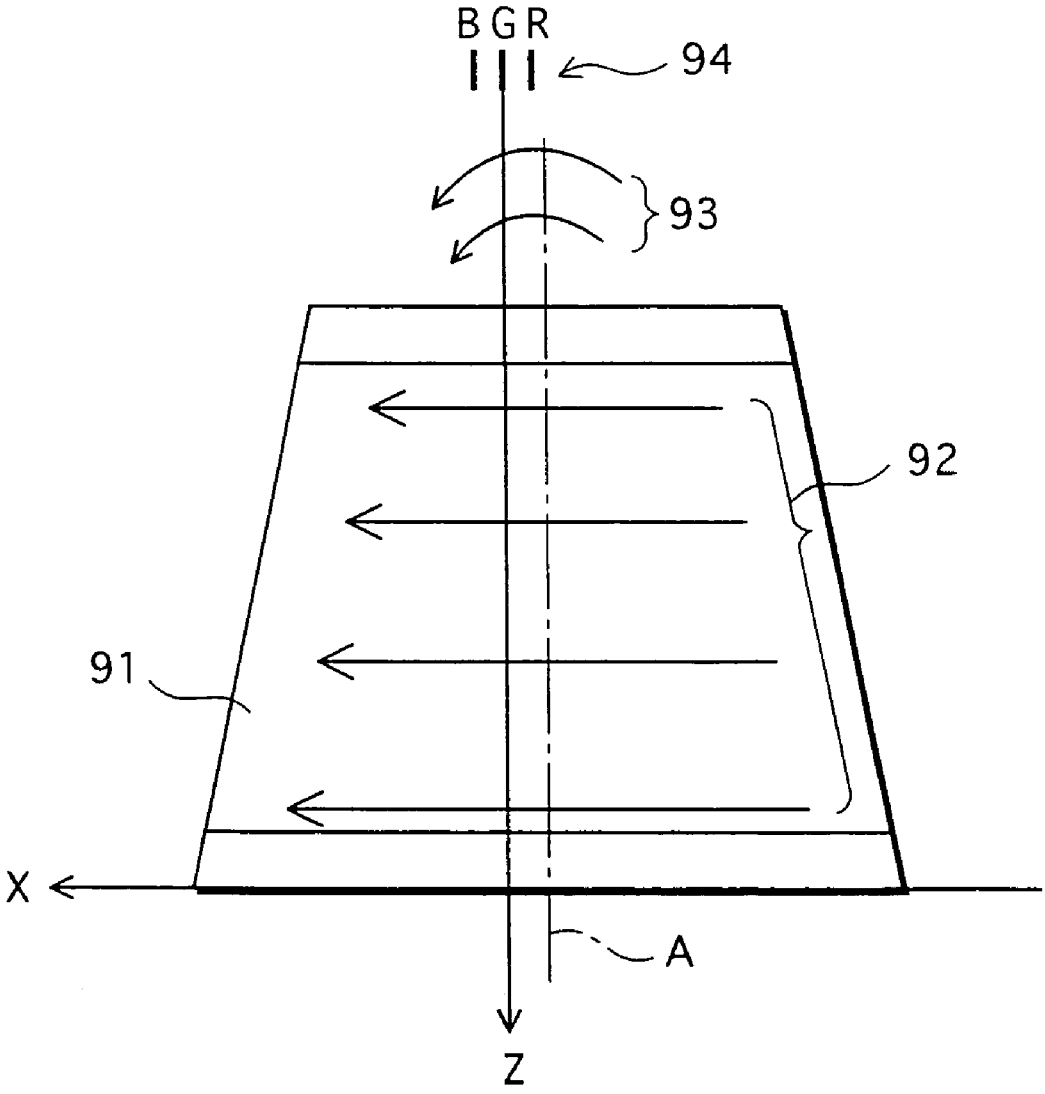
Prior Art FIG. 1
FIG. 1 is a schematic plan view of a ferrite core, the diagram showing the distribution of a magnetic field generated by a vertical deflection coil, with a central axis of the ferrite core offset to the right of the tube axis when viewed from the screen side.

Central axis A of ferrite core 91 (vertical deflection magnetic field) is, as shown in FIG. 1, offset to the right side of tube axis Z, and the distribution of vertical deflection magnetic field 92 is barrel shaped. For this reason, the differential between magnetic field 92 (magnetic flux density) actually applied to electron beams 30 and magnetic field 92 (magnetic flux density) that should originally have been applied is exacerbated in the order blue (B), green (g), red (R).

Figure 2:
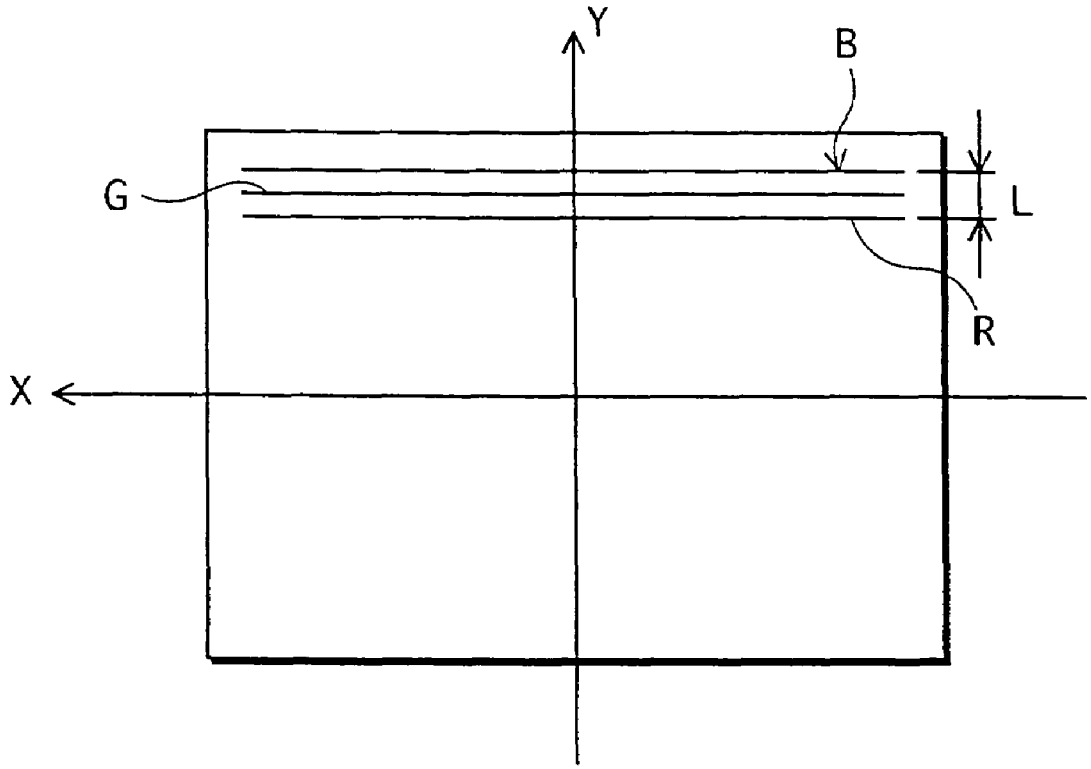
Prior Art FIG.2
FIG. 2 shows misconvergence that occurs on the screen when the distribution of the magnetic field generated by the vertical deflection coil is as shown in FIG. 1.

Consequently, when electron beams 30 emitted from electron gun 24 are deflected upwardly by vertical deflection magnetic field 92, the deflection amount increases in the order blue, green, red as shown in FIG. 2, with the blue electron beam B landing highest up on the face panel and red electron beam R landing furthest down. In this case, a distance L between the blue and red electron beams was approximately 2.5 mm in testing.

The following description relates to when deflection yoke 14 has magnetic body 40 attached thereto.

Magnetic body 40 used in experimentation had a height H of 15 mm, a width b of 5 mm, an interval D between opposing arms 401 and 402 of 3 mm, and a thickness T of 0.5 mm (see FIG. 5).

Figure 6:
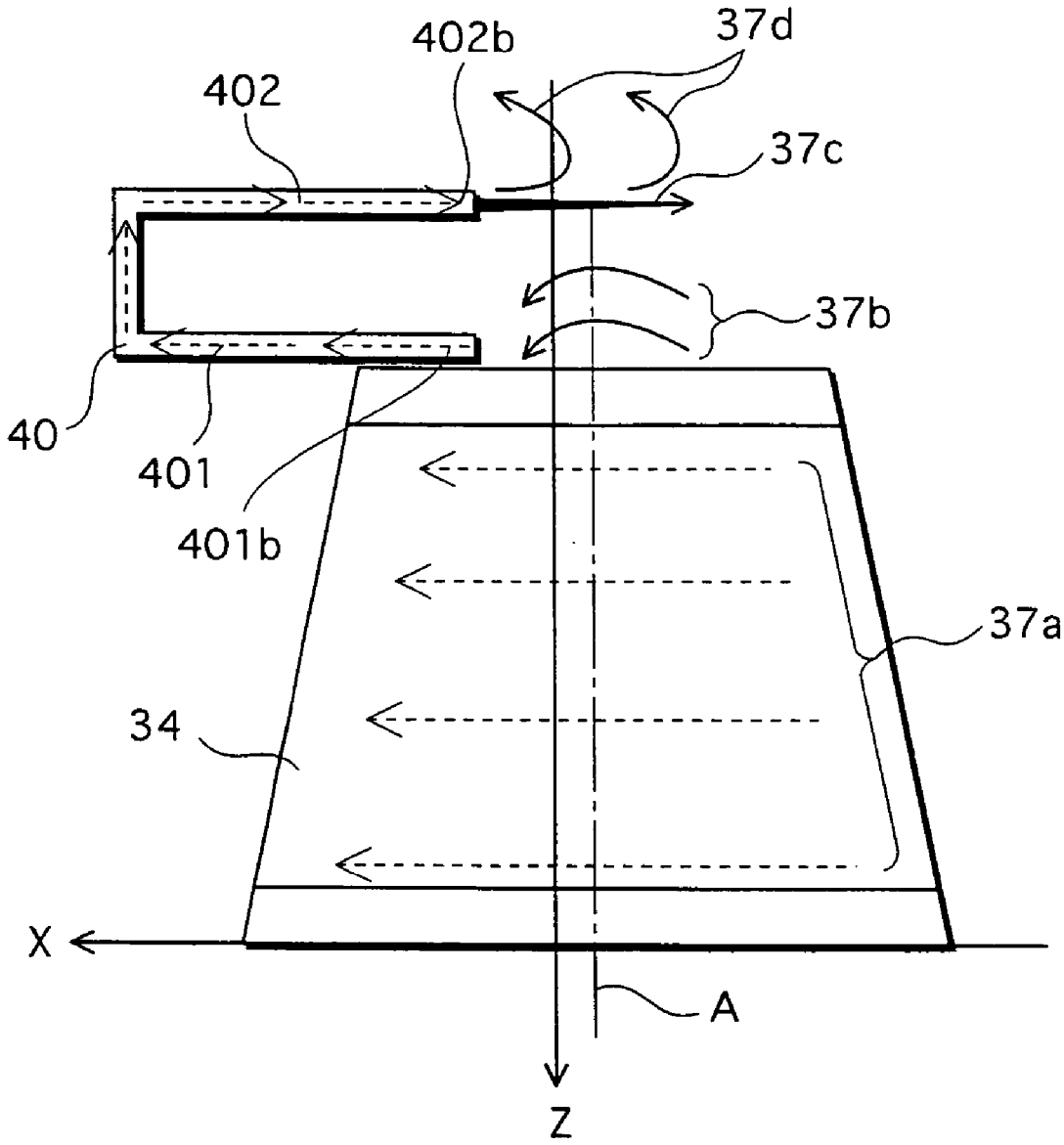
FIG. 6 is a schematic plan view of a ferrite core, the diagram showing the distribution of a magnetic field generated by a vertical deflection coil when a magnetic body is mounted on an end thereof, with the central axis of the ferrite core offset to the right of the tube axis when viewed from the screen side.
Figure 7A:
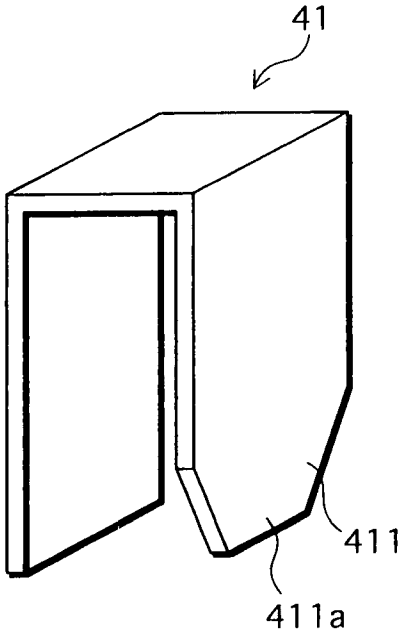
FIGS. 7A to 7C show variations of the magnetic body.
Figure 7B:
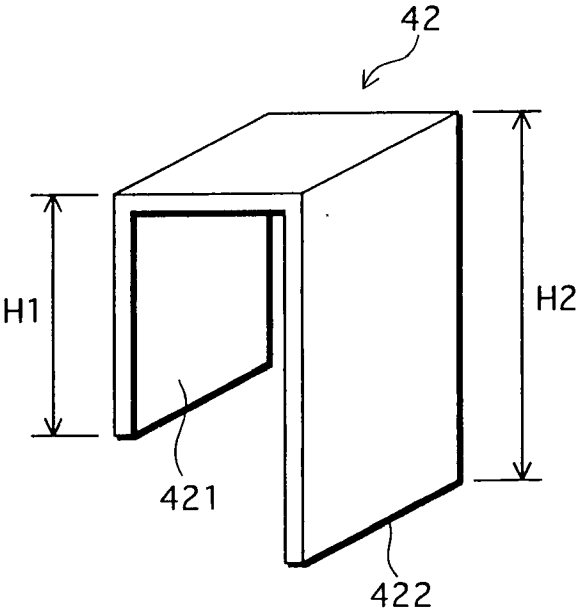
Figure 7C:
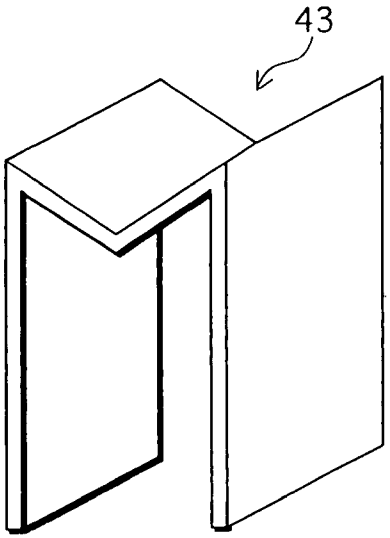
Figure 8A:
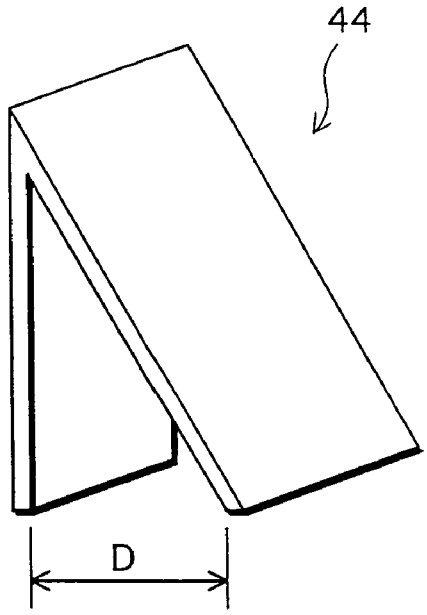
FIGS. 8A & 8B show variations of the magnetic body.
Figure 8B:
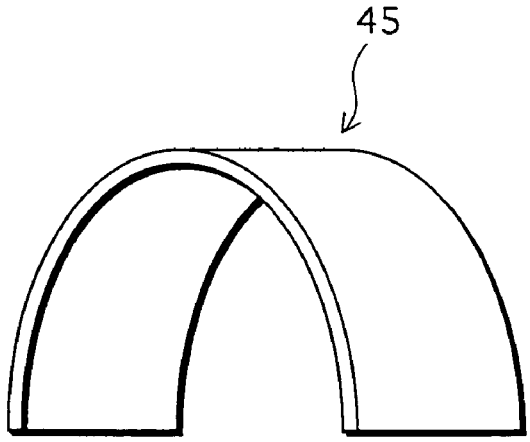

FIG. 6 is a schematic plan view of ferrite core 34, the diagram showing the distribution of the magnetic field generated by vertical deflection coil 36 when magnetic body 40 is mounted on an end thereof, with the central axis A of ferrite core 34 offset to the right side of tube axis Z when viewed from the screen side. Note that, although not depicted in FIG. 6, vertical deflection coil 36 is wound around ferrite core 34.

A vertical deflection magnetic field 37*a* distributed within ferrite core 34, being the same as that described in the Related Art section of this specification, is indicated for reference purposes in FIG. 6 using broken lines. Note that the orientation of magnetic field 37*a* and a leakage magnetic field 37*b* when the electron beams have been upwardly deflected is indicated by the arrows, as in FIG. 1.

Magnetic body 40, in experimentation, was inserted from the left side along the horizontal axis, with the positioning thereof being determined while looking at the misconvergence of electron beams 30 on the screen. Note that magnetic body 40 was inserted with opposing arm 401 positioned on the ferrite core side.

Magnetic body 40 was inserted from the opposite side to the side (right side in the present embodiment) on which central axis A of ferrite core 34 is laterally offset with respect to tube axis Z. Magnetic body 40 was, specifically, ultimately attached so that the interval between tube axis Z and the end face of opposing arm 402 on the electron gun side was around 18 mm, with misconvergence on the screen being eliminated by this positioning.

The interval between tube axis Z and the end face of magnetic body 40 was calculated using the distance between the outside of neck 23 and the end face of magnetic body 40, given that the measurements of the outer surface of neck 23 are known. Note that neck 23 in the cathode-ray tube used in the experimentation had an outer diameter of 29 mm.

b. Reasons for Misconvergence being Eliminated

The reasons for misconvergence being ameliorated by using the magnetic body are described here.

Firstly, as shown in FIG. 6, leakage magnetic field 37*b*, which is on the electron gun side of ferrite core 34, leaks from the right side on the electron gun side when viewed from the screen side, and, like vertical deflection magnetic field 37*a* within ferrite core 34, flows to the left side. Leakage magnetic field 37*b* flowing to the left side is thought to be drawn in through the end face of opposing arm 401 on the ferrite core side of magnetic body 40 attached on the left-side end face (when viewed from the screen side) of ferrite core 34.

As a result of leakage magnetic field 37*b* being drawn in by magnetic body 40, the distribution of leakage magnetic field 37*b* around the environs of the end face of opposing arm 401 is dispersed. As a result, the magnetic flux density of leakage magnetic field 37*b* is reduced from tube axis Z to the end face of opposing arm 401, thereby decreasing the amount by which the electron beams are upwardly deflected. Thus, the distance L between the blue and red electron beams (i.e. the amount of misconvergence) shown in FIG. 2 is reduced.

The leakage magnetic field drawn in by magnetic body 40 is thought to flow to opposing end 402 on the electron gun side of magnetic body 40 as shown by the arrows within magnetic body 40, and finally to emerge from the end face of opposing end 402 toward tube axis Z. This leakage magnetic field that emerges from magnetic body 40 has the effect of deflecting electron beams 30 downwardly.

Also, leakage magnetic field 37*c*, which advances toward tube axis Z in a direction orthogonal to the tube axis, gradually disperses as it moves away from magnetic body 40, and becomes weaker. The amount by which the three electron beams 30 are downwardly deflected increases the closer they fly to magnetic body 40 in the order blue, green, red (here, the blue electron beam is the closest). This is the same order of greatest upward deflection of the three electron beams when magnetic body 40 is not provided.

Consequently, it is thought that since electron beams 30 prior to entering deflection yoke are downwardly deflected by leakage magnetic field 37*c*, the three electron beams can be aligned on the screen.

The electron beams prior to entering the area of the deflection yoke are thus thought to be downwardly deflected as a result of leakage magnetic field 37*c*, and furthermore, the amount of Yv misconvergence is thought to be reduced as a result of the deflected electron beams passing through the barrel-shaped vertical deflection magnetic field, thus enabling the three electron beams to be aligned on the screen.

As described above, leakage magnetic field 37*b* in the environs of opposing arm 401 is absorbed as a result of attaching magnetic body 40 having a simple structure to ferrite core 34. This reduces the magnetic flux density of leakage magnetic field 37*b* in the environs of opposing arm 401, thereby decreasing the amount by which the electron beams are upwardly deflected. On the other hand, the absorbed leakage magnetic field 37*c* is emitted toward tube axis Z from opposing arm 402 of magnetic body 40 in the opposite direction to that of leakage magnetic field 37*a* leaked from ferrite core 34. The electron beams are downwardly deflected as a result. The cumulative effect of this is thought to be the amelioration of Yv misconvergence on the screen.

c. Adjustment of Deflection Amount of Electron Beams by Leakage Magnetic Field

The amount by which the electron beams are deflected by the leakage magnetic field expelled from the end face of the opposing arm on the electron gun side of the magnetic body can be adjusted by altering the distance between the magnetic body and the tube axis, and also, for example, by changing the interval between the pair of opposing arms, or by changing the distance that the absorbed leakage magnetic field flows within the magnetic body; that is, by changing the overall length of the magnetic body.

Variations

Although the present invention has been described above based on a preferred embodiment, the technological scope of the present invention is, of course, not limited to the preferred embodiment. It is possible to consider, for example, the following variations.

(1) Shape of Magnetic Body

Magnetic body 40, while being described in the preferred embodiment as having a squared "U" shape, may take other forms.

FIGS. 7A-7C and FIGS. 8A-8B show variations on the form of the magnetic body.

With magnetic body 40 of the preferred embodiment, opposing arms 401 and 402 are substantially rectangular in shape when viewed from the direction in which parts 401 and 402 are separated from one another ($Z_1$ direction in FIG. 5). As with a magnetic body 41 shown in FIG. 7A, however, at least one corner of the leading edge of an opposing arm 411 or both opposing arms may be removed. The leading edge in this case may have a flat part 411*a* in a width direction ($X_1$ direction in FIG. 5), or may have a peaked shape formed into an obtuse or acute angle without a flat part.

Also, the height of the pair of opposing arms need not be the same. For example, opposing arms 421 and 422 may have different heights (H1, H2), as with a magnetic body 42 shown in FIG. 7B. Furthermore, the magnetic body may, apart from having a squared "U" shape, be "M" shaped, as with a magnetic body 43 shown in FIG. 7C, for example. That is, as long as the shape of the connecting part (i.e. the doubled-back part) allows the pair of opposing arms to be connected so that the ends thereof are separated in the tube axis direction, the shape of the opposing arms is not particularly limited.

Furthermore, the opposing arms need not be parallel with one another. For example, the shape of the magnetic body may be such that the opposing arm on the electron gun side is sloped with respect to the opposing arm on the ferrite core side, examples of which include an asymmetrical "V" shape as with a magnetic body 44 shown in FIG. 8A, or a semi-oval shape (including a semi-circular shape) as with a magnetic body 45 shown in FIG. 8B.

The opposing arm on the ferrite core side of the magnetic body, while described in the preferred embodiment as being substantially parallel with the end face of the ferrite core, need not be parallel with the end face. However, when the magnetic body is attached to the end face of the ferrite core, the attachment is, needless to say, facilitated if the opposing arm on the magnetic body is parallel with the end face of the ferrite core.

(2) Attachment Position of Magnetic Body

While the magnetic body is described in the preferred embodiment as being attached to the end face of the ferrite core on the electron gun side, as long as the magnetic body is in a position that allows for the absorption of the leakage magnetic field leaked from the deflection yoke on the electron gun side, the magnetic body may be attached other than to the end of the ferrite core, and may, for example, be attached to the resin frame. Even if attached to the resin frame, however, the opposing arm on the ferrite core side of the magnetic body preferably is in contact with the ferrite core. This is because the leakage magnetic field is more efficiently absorbed when there is contact.

(3) Magnetic Body Measurements a. Interval Between Opposing Arms

Interval D between the opposing arms in FIG. 5, while described in the preferred embodiment as being 3 mm (approx. 7% of the overall length of the ferrite core), may be greater than or equal to 1.5 mm. This is because there is a reduction in the amount by which misconvergence can be decreased if interval D is less than 1.5 mm, and the effects of attaching the magnetic body are not obtained. Note also that while misconvergence can be decreased even when interval D between the opposing arms takes a large value, there is an area within the electron gun that the magnetic field is unable to penetrate, meaning that the electron beams cannot be deflected when the absorbed magnetic field is emitted into this area of the electron gun. Consequently, the distance from the end face of the ferrite core on the electron gun side to the area of the electron gun into which the magnetic field cannot penetrate is the effective upper value of interval D between the opposing arms.

b. Width

Width b of the magnetic body, while described in the preferred embodiment as being 5 mm, may be greater than or equal to 3 mm, and preferably is less than or equal to the outer diameter of the neck of the funnel (29 mm in the preferred embodiment).

Figure 9A:
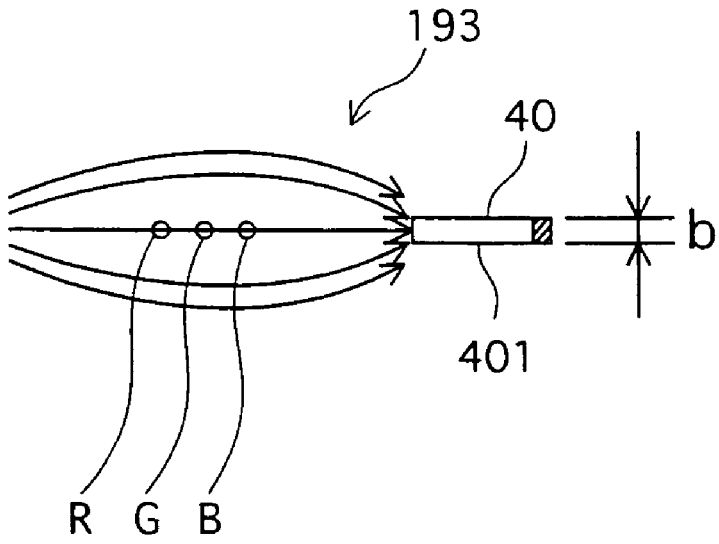
FIGS. 9A & 9B show the distribution of a leakage magnetic field for different widths of the magnetic body.
Figure 9B:
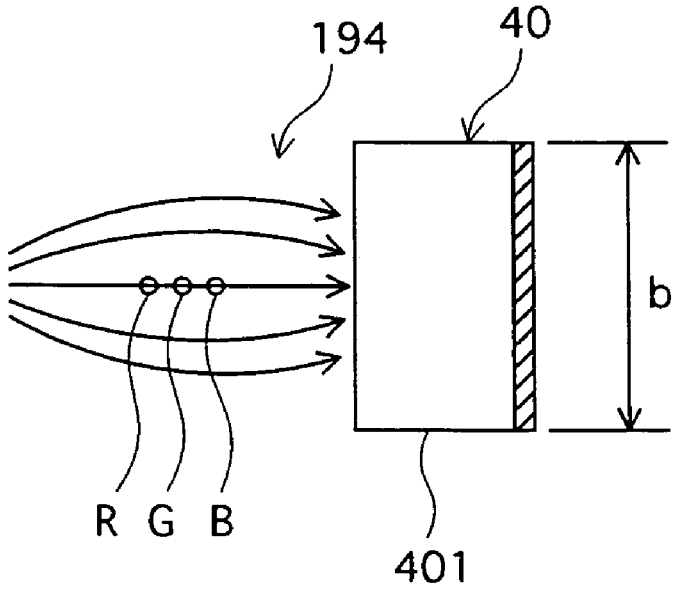

If width b is less than 3 mm, a leakage magnetic field 193 in a vicinity of magnetic body 40 is, as shown in FIG. 9A, not effectively absorbed, resulting in the effects of attaching the magnetic body not being obtained because of the limited change in the distribution of the leakage magnetic field. On the other hand, while a leakage magnetic field 194 is effectively diffused and the magnetic flux density reduced when width b is greater than the outer diameter of the neck, as shown in FIG. 9B, the fact that the electron beams prior to entering the deflection yoke fly along the tube axis means that they are too far removed from the diffused leakage magnetic field, resulting in the effects of the reduced magnetic flux density not being obtained.

(4) Magnetic Body

In the preferred embodiment, as shown in FIG. 6, magnetic body 40 is disposed on the end face of the ferrite core on the electron gun side, and absorbs leakage magnetic field 37*b* leaked from ferrite core 34 on the electron gun side. That is, use is made of leakage magnetic field 37*b*.

However, part of vertical deflection magnetic field 37*a* within ferrite core 34 may be used in addition to leakage magnetic field 37*b*. Specifically, part of the ferrite core may be removed and a leading edge of the magnetic body secured in the cutaway part. That is, the magnetic body may be provided within an area of the deflection yoke on the electron gun side, with the ends thereof separated along the tube axis.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A cathode-ray tube device, comprising:

a cathode-ray tube that includes a glass bulb having a funnel connected to a face panel, and an electron gun disposed within a neck of the funnel;

a deflection yoke that is mounted around an outside of the funnel and deflects an electron beam emitted from the electron gun; and a magnetic body doubled back partway along in a longitudinal direction so that a first end and a second end in the longitudinal direction extend toward a tube axis of the cathode-ray tube, and provided in a vicinity of an electron gun side of the deflection yoke, with the first end positioned nearer the deflection yoke than the second end.

2. The cathode-ray tube device of claim 1, wherein the magnetic body has a squared "U" shape, and is disposed in a state in which, of opposing arms, at least the arm nearer the deflection yoke is substantially parallel with an end face of the deflection yoke on the electron gun side.

3. The cathode-ray tube device of claim 2, wherein an interval between the opposing arms is at least 1.5 mm.

4. The cathode-ray tube device of claim 3, wherein a vertical deflection coil included in the deflection yoke generates a barrel-shaped magnetic field, and the magnetic body is disposed with a central axis, which is parallel with a longitudinal direction of at least one of opposing arms of the magnetic body, substantially aligned with a horizontal axis of the cathode-ray tube.

5. The cathode-ray tube device of claim 2, wherein a width of the magnetic body is at least 3 mm and less than or equal to an external diameter of the neck of the funnel.

6. The cathode-ray tube device of claim 5, wherein the magnetic body is provided only on a side of the tube axis opposite that on which a vertical deflection coil included in the deflection yoke is laterally offset, so that the tube axis is positioned therebetween.

7. The cathode-ray tube device of claim 1, wherein the magnetic body is disposed in a state in which, of opposing arms, the arm nearer the electron gun is substantially orthogonal to the tube axis.

8. The cathode-ray tube device of claim 1, wherein a vertical deflection coil included in the deflection yoke generates a barrel-shaped magnetic field, and the magnetic body is disposed with a central axis, which is parallel with a longitudinal direction of at least one of opposing arms of the magnetic body, substantially aligned with a horizontal axis of the cathode-ray tube.

9. The cathode-ray tube device of claim 1, wherein the magnetic body is provided only on a side of the tube axis opposite that on which a vertical deflection coil included in the deflection yoke is laterally offset, so that the tube axis is positioned therebetween.

10. The cathode-ray tube device of claim 8, wherein the vertical deflection coil is toroidally wound around a bell-shaped core, and the magnetic body is mounted on an end face of a minor diameter side of the core.

11. The cathode-ray tube device of claim 1, wherein the magnetic body has a squared "U" shape, and is disposed in a state in which, of opposing arms, at least the arm nearer the deflection yoke is substantially parallel with an end face of the deflection yoke on the electron gun side, and the arm nearer to the electron gun is substantially orthogonal to the tube axis.

12. The cathode-ray tube device of claim 11, wherein an interval between the opposing arms is at least 1.5 mm.

13. The cathode-ray tube device of claim 11, wherein a width of the magnetic body is at least 3 mm and less than or equal to an external diameter of the neck of the funnel.

14. The cathode-ray tube device of claim 11, wherein the vertical deflection coil is toroidally wound around a bell-shaped core, and the magnetic body is mounted on an end face of a minor diameter side of the core.

* * * * *